US007384010B2

(12) United States Patent
Horigane et al.

(10) Patent No.: US 7,384,010 B2
(45) Date of Patent: Jun. 10, 2008

(54) PROCESS FOR PRODUCING CRUSHED PRODUCT, APPARATUS THEREFOR AND CRUSHED PRODUCT

(75) Inventors: Akira Horigane, Tsukuba (JP); Masaaki Horiguchi, Tsukuba (JP)

(73) Assignee: Tsukuba Food Science, Ushiku-shi, Ibaraki (JP)

( * ) Notice: Subject to any disclaimer, the term of this patent is extended or adjusted under 35 U.S.C. 154(b) by 176 days.

(21) Appl. No.: 11/080,842

(22) Filed: Mar. 15, 2005

(65) Prior Publication Data

US 2006/0138256 A1 Jun. 29, 2006

Related U.S. Application Data

(63) Continuation-in-part of application No. 11/025,654, filed on Dec. 29, 2004, now abandoned.

(51) Int. Cl.
*B02C 7/12* (2006.01)

(52) U.S. Cl. ..... 241/23; 241/57; 241/65; 241/261.2; 241/DIG. 37

(58) Field of Classification Search ..... 241/261.2, 241/261.3, DIG. 37, 23, 65, 57
See application file for complete search history.

(56) References Cited

U.S. PATENT DOCUMENTS 4,060,206 A * 11/1977 Granzow ..... 241/259.1
4,090,672 A * 5/1978 Ahrel ..... 241/261.1
4,222,527 A * 9/1980 Davis ..... 241/33
4,383,650 A * 5/1983 Contal et al. ..... 241/66
6,607,153 B1 * 8/2003 Gingras ..... 241/261.3

* cited by examiner

*Primary Examiner*—Mark Rosenbaum
(74) *Attorney, Agent, or Firm*—Flynn, Thiel, Boutell & Tanis, P.C.

(57) ABSTRACT

A process for producing an oxygen-free, non-denaturable, cooled and dried crushed product of superior quality by effecting efficient crushing by a simple apparatus in an easy operation while preventing a decrease in qualities such as flavor, taste and masticating feel; an apparatus therefor; and a crushed product obtained thereby are provided. The apparatus for producing crushed product contains a pair of crusher discs arranged so as to define a crushing space in between confronting crushing faces thereof, a driver for rotating one of the pair of crusher discs, a cooling section adjoining the other crusher disc for cooling it, a raw material supply site for supplying one or more raw materials to the crushing space through the cooling section, a crushed product delivery site for bringing the resulting crushed product thereto from the crushing space and an inert gas supply for supplying a cooled inert gas to the crushing space via the raw material supply site.

13 Claims, 7 Drawing Sheets

PROCESS FOR PRODUCING CRUSHED PRODUCT, APPARATUS THEREFOR AND CRUSHED PRODUCT

This application is a continuation-in-part of U.S. Ser. No. 11/025,654, filed Dec. 29, 2004 now abandoned.

FIELD OF THE INVENTION

The present invention relates to a process for producing a crushed product by crushing a raw material, for example, a food raw material such as wheat, rice, buckwheat, or other, to an apparatus therefor and to a crushed product. More specifically, the present invention relates to a process for producing a crushed product by crushing a raw material using a pair of crushing discs disposed in opposition to each other, to an apparatus therefor and to a crushed product obtained thereby.

DESCRIPTION OF THE RELATED TECHNIQUES

As a process for producing a crushed product by crushing a raw material, for example, a food raw material such as a biological product, organic substance or chemical product, a technique has long been in practical use, as seen in, for example, a stone mill in which a food raw material is milled using a pair of opposingly disposed milling discs or plates. In such a technique, the food raw material is supplied to the interstice between the pair of milling discs, while rotating at least one of the pair of discs, to effect crushing of the raw material in between the paired milling discs to produce a crushed product.

In order to increase the production efficiency and reduce the size of the apparatus in such a technique, a contrivance may be possible, in which steel discs are used so as to withstand high speed rotation under crushing resistance, wherein, however, a considerable heat generation and possible oxidation of the crushed product attributive to a denaturation of component substances, result in a decrease in the flavor, taste and masticating feel of a food product made of the crushed product and so on, should be prevented. In industrial large scale apparatus, a countermeasure for such a problem may be relatively easily incorporated, for example, by total cooling of the apparatus. However, total cooling of the apparatus may not be tolerated for a household compact apparatus due to an increase in the size and cost.

A crushing apparatus of the crushing disc rotation type has a construction, in which one of the paired discs is rotated by a driving means, wherein the disc on the side of the driving means is rotated and, thus, the driving means should be designed in a complicated structure, so that cooling of the disc on the side of the driving means is difficult. Whereas cooling of the disc on the side opposite to the driving means, namely the stationary disc, can be realized easily, the cooling effect may difficultly reach the disc of the rotary side, whereby the prevention of denaturation of the crushed product may be difficult to attain.

In Japanese Patent Kokai Hei 11-151080 A, a technique for producing a freeze-dried product is disclosed, in which a material to be processed is mixed with dry ice and the resulting mixture is crushed to attain freezing of the crushed product while replacing the ambient atmosphere with the thereby generated carbon dioxide gas, whereupon the frozen product is subjected to vacuum drying. There is, however, no disclosure in this patent literature as to the technique for producing a crushed product while preventing denaturation of the crushed product by means of a pair of crusher discs.

SUMMARY OF THE INVENTION

The purpose of the present invention is to provide a process for producing a crushed product which is superior in product quality and devoid of denaturation and is cooled and dried, in the absence of oxygen, by performing efficient crushing of a raw material by means of a simple apparatus with simple operation under prevention of product quality, such as flavor, taste, masticating feel and so on, and to provide an apparatus therefor as well as a crushed product obtained thereby.

DISCLOSURE OF THE INVENTION

The purpose of the present invention is attained by the process, apparatus and crushed product as given below:

(1) A process for producing crushed product, comprising defining a crushing space in between crushing faces of a pair of confronting crusher discs, rotating one of said confronting crusher discs by a driving means, cooling the crusher discs through a cooling section, supplying one or more raw materials to the crushing space from a raw material supply site, supplying a cooled inert gas to the crushing space, effecting crushing of the raw material(s) under the cooling thereof while replacing ambient oxygen on and around the raw material(s) by the inert gas and bringing out the resulting crushed product from the crushing space to a crushed product delivery site.

(2) A process for producing a crushed product, comprising defining a crushing space in between crushing faces of a pair of confronting crusher discs, rotating one of said confronting crusher discs by a driving means, cooling the other one of the crusher discs through a cooling section disposed adjacent thereto, supplying one or more raw materials to the crushing space from a raw material supply site through a cooling section, supplying a cooled inert gas to the crushing space via the raw material supply site, effecting crushing of the raw material(s) under the cooling thereof while replacing ambient oxygen on and around the raw material(s) by the inert gas and bringing out the resulting crushed product from the crushing space to a crushed product delivery site.

(3) The process as defined in the above (1) or (2), wherein the pair of crusher discs is disposed so as to oppose to each other in vertical, horizontal or inclined posture.

(4) The process as defined in any one of the above (1) to (3), wherein the cooling is effected through the cooling section by means of carbon dioxide gas, ice, water, nitrogen gas or a cooling element.

(5) The process as defined in any one of the above (1) to (4), wherein the inert gas is carbon dioxide or nitrogen.

(6) A crushing apparatus comprising a pair of crusher discs arranged so as to define a crushing space in between confronting crushing faces thereof, a driving means for rotating one of the crusher discs, a cooling section for cooling the crusher discs, a raw material supply site for supplying one or more raw materials to the crushing space, a crushed product delivery site for bringing out the resulting crushed product thereto from the crushing space and an inert gas supply means for supplying a cooled inert gas to the crushing space.

(7) A crushing apparatus comprising a pair of crusher discs arranged so as to define a crushing space in between confronting crushing faces thereof, a driving means for rotating one of the crusher discs, a cooling section arranged adjacent to the other one of the crusher discs so as to cool it, a raw material supply site for supplying one or more raw materials to the crushing space through the cooling section, a crushed product delivery site for bringing out the resulting crushed product thereto from the crushing space and an inert gas supply means for supplying a cooled inert gas to the crushing space via the raw material supply site.

(8) The apparatus as defined in the above (6) or (7), wherein the pair of crusher discs are disposed in opposition to each other in vertical, horizontal or inclined posture.

(9) The apparatus as defined in any one of the above (6) to (8), wherein the cooling section performs cooling by means of carbon dioxide gas, ice, water, nitrogen gas or a cooling element.

(10) The apparatus as defined in any one of the above (6) to (9), wherein the inert gas is carbon dioxide or nitrogen.

(11) The apparatus as defined in any one of the above (6) to (10), wherein the crushing space is composed of a rough crushing space constructed from deeper grooves effective for roughly crushing the raw material(s) and a fine powder crushing space constructed from arcuate shallower thin grooves effective for finely crushing the roughly crushed product into micropowder.

(12) The apparatus as defined in the above (11), wherein the deeper groove for rough crushing and the shallower thin groove for fine crushing are arranged as arcuate grooves connected with each other and running so as to coincide with the flow line of the fine powder observed on the crusher disc in accordance with the revolution number of the rotating disc.

(13) A crushed product obtained by the process as defined in any one of the above (1) to (5).

(14) A processed article comprising the crushed product obtained by the process as defined in the above (13).

DETAILED DESCRIPTION OF THE DISCLOSURE

For the raw material(s) to be crushed in accordance with the present invention, there is no limitation so long as it permits crushing, while those which are subject to denaturation of any of the constituent components by heat and/or oxidation may be taken in more consideration. For such raw materials, there may be recited, for example, food raw materials, such as wheat, rice, buckwheat and the like, organisms, organic substances, chemical products and others.

The apparatus to be used for producing the crushed product according to the present invention comprises a pair of crusher discs arranged so as to define a crushing space in between confronting crushing faces of the discs, a driving means for rotating one of the crusher discs, a cooling section for cooling the crusher discs, a raw material supply site for supplying one or more raw materials to the crushing space, a crushed product delivery site for bringing out the resulting crushed product thereto from the crushing space and an inert gas supply means for supplying a cooled inert gas to the crushing space. A preferable crushing apparatus is constructed from a pair of crusher discs arranged so as to define a crushing space in between confronting crushing faces of the discs, a driving means for rotating one of the crusher discs, a cooling section arranged adjacent to the other one of the crusher discs so as to cool it, a raw material supply site for supplying one or more raw materials to the crushing space through the cooling section, a crushed product delivery site for bringing the resulting crushed product thereto from the crushing space and an inert gas supply means for supplying a cooled inert gas to the crushing space via the raw material supply site.

The confronting crushing faces of the pair of crusher discs may preferably be processed in a rough surface adapted for effecting crushing of the raw material(s) and, if necessary, in a form of file. The roughness of the crushing faces may preferably have a distribution in such a manner that it is coarser on the raw material supply side and is finer on the crushed product delivery side. The distance between the crushing faces that forms the crushing space may be such that it is greater on the raw material supply side than on the crushed product delivery side. A preferable crushing space is composed of a rough crushing space constructed from deeper grooves effective for roughly crushing the raw material(s) and a fine powder crushing space constructed from arcuate shallower thin grooves effective for finely crushing the roughly crushed product into micropowder. It is preferable that the deeper grooves for rough crushing and the arcuate shallower thin grooves for fine crushing are arranged as arcuate grooves connected with each other and running along the flow line of the fine powder observed on the disc face in accordance with the revolution number of the rotating disc. The deeper grooves constituting the rough crushing space may have each a width of 3-15 mm and a depth of 0.5-15 mm, which can be formed by mechanical processing on, for example, a milling machine. The arcuate shallower thin grooves constituting the fine powder crushing space may have a width of 1-1000 μm and a depth of 0.5-50 μm, which can be formed by processing by means of, for example, laser machining or water-jet machining.

While the pair of crusher discs may preferably be formed each in a configuration of circular disc, other configurations may be possible. While the crusher discs may be disposed in any voluntary posture, such as vertical, horizontal or inclined posture, they may particularly preferably be disposed in a vertical or nearly vertically inclined posture since, thereby, the resulting crushed product can more easily be taken out. One of the pair of crusher discs is constructed as a rotary disc connected to a driving means. The other disc may preferably be designed as a stationary disc not subject to rotation for facilitating easy and voluntary arrangement of the cooling section and the raw material supply site, though it may be allowed to be designed as a rotary disc.

The cooling section is arranged adjoining the other crusher disc, namely, non-rotary one, in a manner adapted to cool the crusher disc. The raw material supply site communicates with the crushing space through the cooling section to allow the raw material to be supplied thereto in a cooled condition. It is preferable that the raw material supply site communicates with the crushing space via the center of the non-rotary crusher disc, since the traveling distance of the raw material over the crushing face will thereby be equalized in all directions, though communication via other positions of the crusher disc may be allowable. The crushed product delivery site may preferably be located at a position on the periphery of the pair of crusher discs, in particular, at the lower end in the case where the crusher discs are arranged vertically or in a nearly vertical inclined posture, since thereby discharge of the crushed product becomes easy, though other locations may be allowed.

In the cooling section, cooling is effected by using a cooling medium, such as carbon dioxide (dry ice), ice, water, nitrogen gas or hydrogen gas, or using a cooling element. Use of dry ice as the cooling medium is preferable, since it allows easy handling and the thereby generated carbon dioxide gas due to sublimation from the dry ice can be used directly as the inert gas, though use of cooled carbon dioxide gas may be permitted. Also use of nitrogen in a liquid form is permitted for the same reason, while use of cooled nitrogen gas is possible. When ice or water is used as the cooling medium, a concomitant use of carbon dioxide or nitrogen as the inert gas is allowed. When ice is used as the cooling medium, the cooling section should be designed so as to ease exhaustion of the thereby formed water therefrom. The inert gas supply means is arranged in the case where a cooled inert gas is generated directly from the cooling medium, such as in the case of use of dry ice or liquid nitrogen, so as to permit the supplying of the generated cooled inert gas to the crushing space via the raw material supply site, and in other cases, so as to permit the supplying of a cooled inert gas from an individually provided inert gas source to the crushing space.

The process for producing a crushed product according to the present invention by using the apparatus as described above comprises defining a crushing space in between crushing faces of a pair of confronting crusher discs, rotating one of said confronting crusher discs by a driving means, cooling the crusher discs through a cooling section, supplying one or more raw materials to the crushing space from a raw material supply site, supplying a cooled inert gas to the crushing space, effecting crushing of the raw material(s) under cooling thereof while replacing ambient oxygen on and around the raw material(s) by the inert gas and bringing out the resulting crushed product from the crushing space to a crushed product delivery site. One preferable process for producing a crushed product according to the present invention comprises defining a crushing space in between crushing faces of a pair of confronting crusher discs, rotating one of said confronting crusher discs by a driving means, cooling the other one of the crusher discs through a cooling section disposed adjacent thereto, supplying one or more raw materials to the crushing space from a raw material supply site through a cooling section, supplying a cooled inert gas to the crushing space via the raw material supply site, effecting crushing of the raw material(s) under cooling thereof while replacing ambient oxygen on and around the raw material(s) by the inert gas and bringing out the resulting crushed product from the crushing space to a crushed product delivery site. Since the inert gas is prepared in a dry state, the gasified inert gas can be utilized for drying the raw material(s) and the resulting dried product.

In the above process, cooling through the cooling section will bring about facilitated cooling of the stationary crusher disc adjoining the cooling section, whereas the rotary crushing disc, the raw material and the crushed product found on the side remote from the cooling section may only retardedly be cooled. By the inventive technical measure of supplying the cooled inert gas via the raw material supply site to the crushing space, cooling of the raw material and the rotary crusher disc can be attained by the cooled inert gas together with the attainment of crushing of the raw material under replacement of ambient oxygen gas on and around the raw material with the inert gas.

Here, cooling of the entire crushing discs and the raw material can be attained while excluding oxygen gas on and around the raw material together with attainment of drying of the raw material, whereby any denaturation of raw material can be prevented. The crusher discs can be cooled thereby to a low temperature, even if the rotary crusher disc is rotated at high speed, whereby an efficient crushing of the raw material can be reached. Moreover, the exclusion of the ambient oxygen gas and the drying of the raw material are realized simultaneously to prevent denaturation of the raw material, whereby cooling of the discs and the raw material down to a low temperature can be realized, even if the revolution number of the rotary disc is further increased to reach a high crushing efficiency.

As described above, the present invention provides a process for producing a crushed product of superior quality, an apparatus therefor and a crushed product of superior quality, in which one or more raw materials are crushed efficiently using a simple apparatus by a simple operation while preventing debasement of qualities, such as flavor, taste, dietary feel, maintenance of essential components and so on, under exclusion of ambient oxygen gas to obtain a dried and cooled crushed product of superior quality without suffering from denaturation, by the inventive features comprising, defining a crushing space in between crushing faces of a pair of confronting crusher discs, rotating one of said confronting crusher discs by a driving means, cooling the crusher discs through a cooling section, supplying one or more raw materials to the crushing space from a raw material supply site, supplying a cooled inert gas to the crushing space, effecting crushing of the raw material(s) under the cooling thereof while replacing ambient oxygen on and around the raw material(s) by the inert gas and bringing out the resulting crushed product from the crushing space to a crushed product delivery site.

A fine powder of microparticles having particle sizes of several tens of micrometers produced by the process for producing a crushed product with cooling under the exclusion of oxygen gas according to the present invention can effectively retain the enzyme activity of, for example, α-amylase, GOT (glutamic oxaloacetic transaminase), or so on, and is therefore adapted to use for diagnosis of spike germination of cerial corns by dry chemistry using α-amylase as an indicator. Further, the present invention can be utilized for assessment of a mycotoxin, such as DON (deoxynivalenol), originating from microbes, such as *Fusarium* etc., facilitated by rain or damp disaster, by observing the α-amylase activity of the microparticles.

THE BEST MODE FOR EMBODYING THE INVENTION

Below, the present invention will be described in more detail by way of mode of embodiments with reference to the appended Drawings.

Example 1

Figure 1:
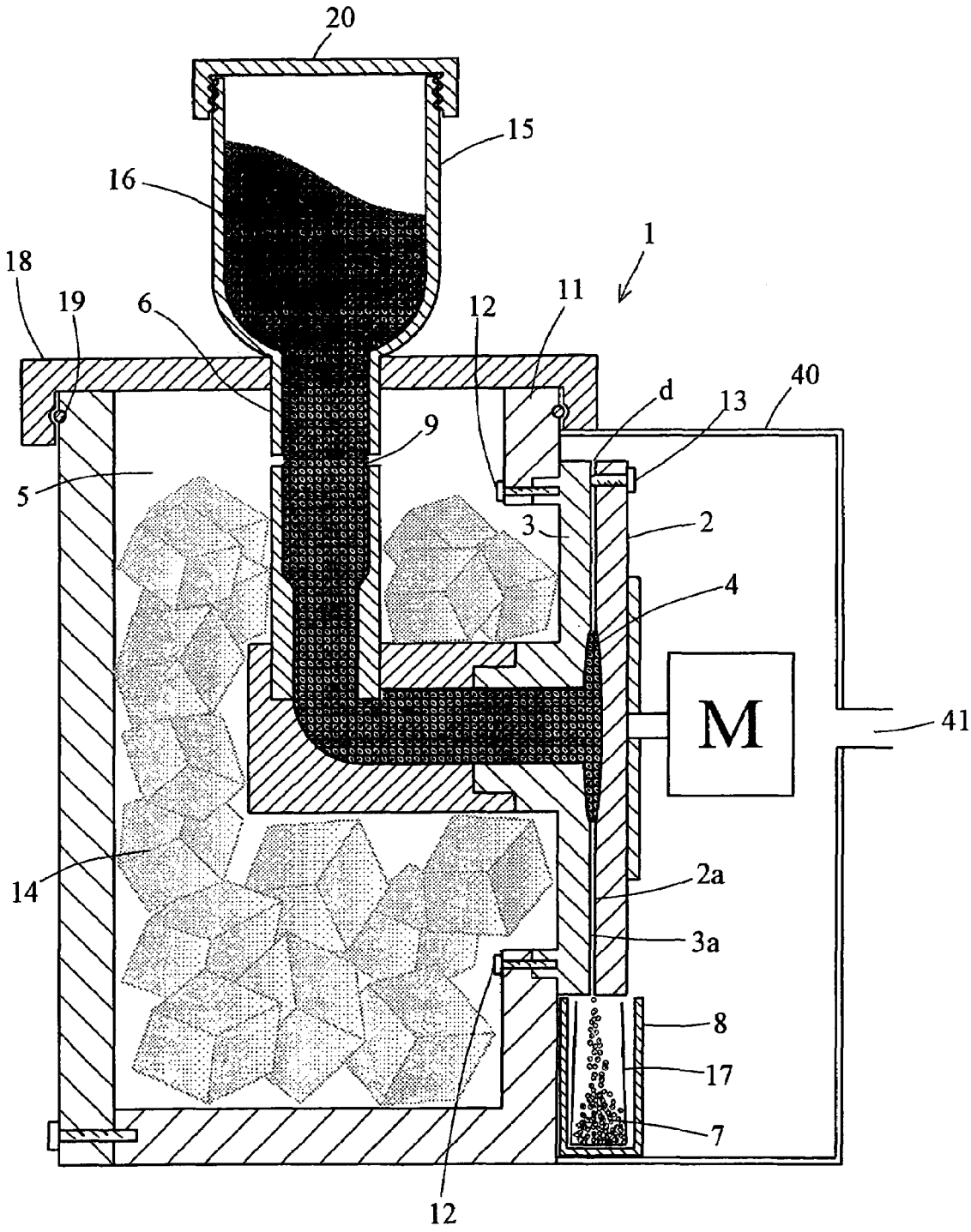
FIG. 1 shows a vertical section of the apparatus for producing the crushed product of Example 1.

In FIG. 1, the apparatus for producing crushed product used in Example 1 is shown in a vertical front view.

The apparatus 1 for producing the crushed product according to the present invention shown in FIG. 1 is constructed from a pair of crusher discs 2 and 3 disposed with their crushing faces 2*a* and 3*a* opposing each other to form therebetween a crushing space 4, a driving means M for driving one of the crusher disc 2 to rotate, a cooling section 5 arranged adjoining the other crusher disc 3 so as to effect the cooling thereof, a raw material supply site 6 arranged to supply the crushing space 4 with one or more raw materials through the cooling section 5, a crushed product delivery site 8 for bringing out the resulting crushed product 7 from the crushing space 4 and an inert gas supply means 9 for supplying a cooled inert gas via the raw material supply site 6 to the crushing space 4.

The confronting crushing faces 2*a* and 3*a* of the pair of crusher discs 2 and 3 are processed each in a file-like form as a rough surface adapted to effect crushing of the raw material. The surface roughness of the crushing faces 2*a* and 3*a* is designed in such a manner that it is coarser on the side of the raw material supply site 6 and is finer on the side of the crushed product delivery site 8. The distance between the crushing faces 2*a* and 3*a* that form the crushing space 4 is designed such that it is greater on the side of the raw material supply site 6 than on the side of the crushed product delivery site 8.

In this Example, the pair of crusher discs 2 and 3 are formed each in a circular disc and are disposed in a vertical posture, while they may be disposed in an inclined posture. Of the pair of crusher discs, one crusher disc 2 is bound to a driving means M and is designed to be rotatable. The other crusher disc 3 is designed as a stationary disc by being fixed on the side wall 11 of the cooling section 5 by screw bolts 12 and is disposed adjacent to the cooling section 5. A spacer 13 in a form of a bolt is arranged in a peripheral part of the rotary disc 2 so as to keep a gap d between the crushing faces 2*a* and 3*a* at a constant distance by contacting the top end of the spacer bolt onto the stationary disc 3 while sliding thereon during rotation. The crusher discs 2 and 3 are pressed towards each other.

The cooling section 5 is arranged so as to adjoin the stationary crusher disc 3 to facilitate cooling of the stationary disc and dry ice is stored therein as the cooling medium 14. The raw material supply site 6 communicates with the crushing space 4 through the cooling section 5 via the center of the crusher disc 3, so as to permit the supplying of the crushing space 4 with the raw material 16 filled in a storage 15 (hopper) under cooling in the cooling section 5. The crushed product delivery site 8 is located beneath the pair of vertically disposed crusher discs 2 and 3 near the periphery of these discs and is provided with a receiving vessel (bag) 17 for receiving the resulting crushed product 7.

Since the cooling section 5 is constructed to effect the cooling by means of a cooling medium 14 of dry ice, the thereby generated carbon dioxide gas can be utilized as such for the cooled inert gas. For this, the side wall of the raw material supply site 6 facing the gas phase of the cooling section 5 is provided with openings to be used as the inert gas supply means 9, in order to supply the generated carbon dioxide gas as much for the cooled inert gas to the crushing space 4 via the raw material supply site 6. The cooling section 5 is provided above with a coverage 18 sealed by a sealing member 19. The storage 15 is furnished with a lid 20. The numeral 40 represents a cover case encasing the rotary crusher disc 2 and the driving means M and provided with a gas discharge port 41.

The process for producing a crushed product according to the present invention using the apparatus described above comprises disposing the pair of crusher discs 2 and 3 so as to confront each other to build up therebetween the crushing space 4, driving one (2) of the pair of crusher discs by the driving means M to rotate it and effecting cooling of the other crusher disc 3 by means of a cooling medium 14 (dry ice) stored in the cooling section 5 situated adjoining the disc 3 and, in this state, supplying the raw material 16 from the storage 15 (hopper) to the raw material supply site 6 and, then, to the crushing space 4 therefrom through the cooling section 5 to cool it and effecting crushing of the raw material 16 by rotating the crusher disc 2.

The carbon dioxide gas, which is generated from dry ice when the crusher disc 3 heated by the frictional heat generation caused by the contacting frictional sliding of the spacer bolt on the crusher disc 3 is cooled by dry ice, conducted as cold dry inert gas via the inert gas supply means 9 to the crushing space 4 through the raw material supply site 6, in order to replace oxygen gas present on and around the raw material with the so-conducted carbon dioxide gas and to dry simultaneously the raw material, whereupon the crushing of the so-dried raw material is performed while cooling the raw material and the crusher disc 2. The resulting crushed product 7 is brought out from the crushing space 4 into the receiving vessel (bag) 17 at the crushed product delivery site 8. The receiving vessel (bag) 17 filled with the crushed product 7 is then taken out from the crushed product delivery site 8, whereupon the bag is sealed by, for example, heat sealing to bring it to the final product of manufacture.

By the technical measure given above, the stationary crushing disc 3 can be cooled easily by the adjoiningly disposed cooling section 5. Here, however, the cooling effect may only restrainedly be exerted to the rotary disc 2 and to the raw material 16 or crushed product 17 on the remote side. As a countermeasure, crushing of the raw material can be realized in such a manner that the generated carbon dioxide gas having a considerable low temperature of −78° C. is supplied as the cooled inert gas to the crushing space 4 via the raw material supply site 6 to thereby attain crushing of the raw material 16 under replacement of ambient oxygen gas on and around the raw material and attainment of the simultaneous drying thereof by the cold carbon dioxide gas while cooling the raw material 16, the crushed product 7 and the rotary crusher disc 2. Here the rate of supply of the cold carbon dioxide gas as the cooled inert gas should preferably be such that it suffices the requisite cooling, oxygen gas replacement and drying while retaining the flavor and taste of the resulting product so as not to lose them in vain. The gas evolved from the region of the crushing space is discharged out via the gas discharge port 41 after having been utilized for cooling the rotary crusher disc 2 and the driving means M.

In the manner as above, it is made possible, all in a single process course, to cool the raw material 16 to be crushed, the total arrangement of the pair of crusher discs 2 and 3 and the resulting crushed product 7, to replace ambient oxygen gas on and around the raw material 16 and in the interstices between particles of the resulting crushed product 7 with the carbon dioxide gas generated from dry ice used as the cooling medium and to dry the raw material 16 and the resulting crushed product 7, whereby occurrence of quality debasement of not only the resulting crushed product 7 but also the raw material 16 supplied can be prevented. It is also made possible to maintain the crushing faces 2*a* and 3*a* at a low temperature even if the rotary disc 2 is rotated at a high velocity, whereby an efficient crushing can be realized. Moreover, it is able to perform oxygen gas exclusion and drying of the raw material simultaneously to prevent quality debasement, whereby cooling can be performed down to a lower temperature, even when the disc rotation velocity is furthermore increased to carry out the crushing at a more high efficiency.

As described above, an efficient crushing of the raw material can be realized by means of a simple apparatus by an easy operation as disclosed in the above Example 1, while preventing debasement in the quality, such as flavor, taste, masticating feel and so on, to thereby produce an oxygen-excluded, denaturation-free, dried and cooled crushed product of superior quality. Due to use of dry ice as the cooling medium 14, the cold carbon dioxide gas as generated upon the cooling can be utilized as the cooled inert gas, thus permitting dispensing with the installation of an isolated source of cooled inert gas. By arranging the pair of crusher discs 2 and 3 in a vertical or steeply inclined posture, the resulting crushing product, which is oxygen-excluded, denaturation-free, cooled and dried, can be taken out at a lower position on the periphery of the crusher discs 2 and 3 to be brought out as the final product of manufacture packaged in an oxygen-excluded, denaturation-free, cooled and dried state.

Example 2

Figure 2:
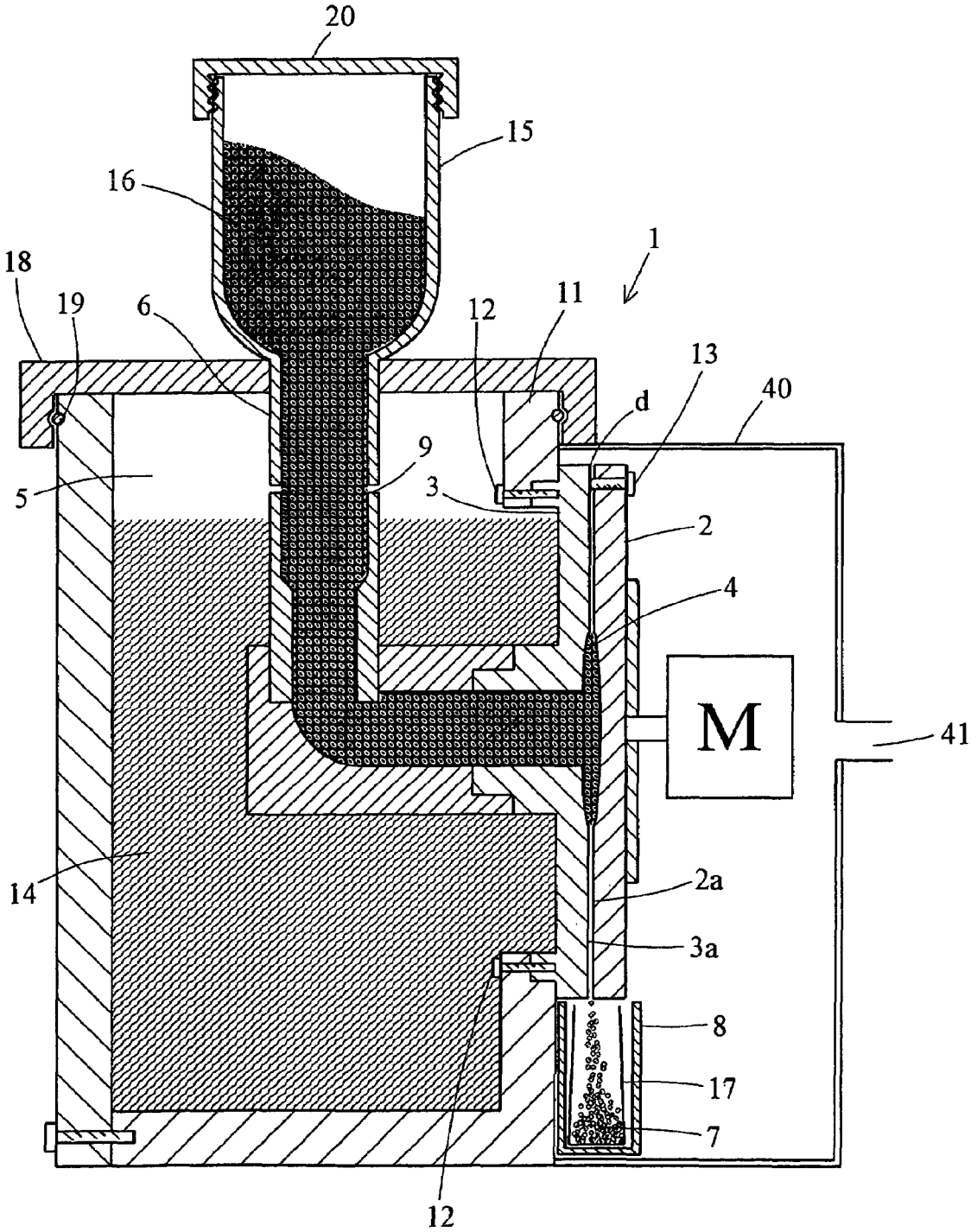
FIG. 2 shows a vertical section of the apparatus for producing the crushed product of Example 2.

In FIG. 2, the apparatus for producing crushed product used in Example 2 is shown in a vertical front view.

The apparatus for producing the crushed product according to the present invention shown in FIG. 2 is constructed in nearly the same manner as that shown in FIG. 1 with the only exception being that liquid nitrogen is used as the cooling medium 14 and others are the same as in Example 1.

The crushed product is produced by the apparatus shown in FIG. 2 in nearly the same way as in Example 1. However, due to the use of liquid nitrogen as the cooling medium 14, the ambient oxygen gas occluded in the raw material is replaced by the vaporized cold nitrogen gas evolved upon cooling by liquid nitrogen with the simultaneous drying of the raw material, by conducting the vaporized nitrogen gas as cooled inert gas from the inert gas supply means 9 through the raw material supply site 6 to the crushing space 4, so as to effect the crushing while cooling the raw material 16, the crushed product 7 and the crusher disc 2. Other operations, functions and effects are nearly the same as those using the apparatus of FIG. 1.

Example 3

Figure 3:
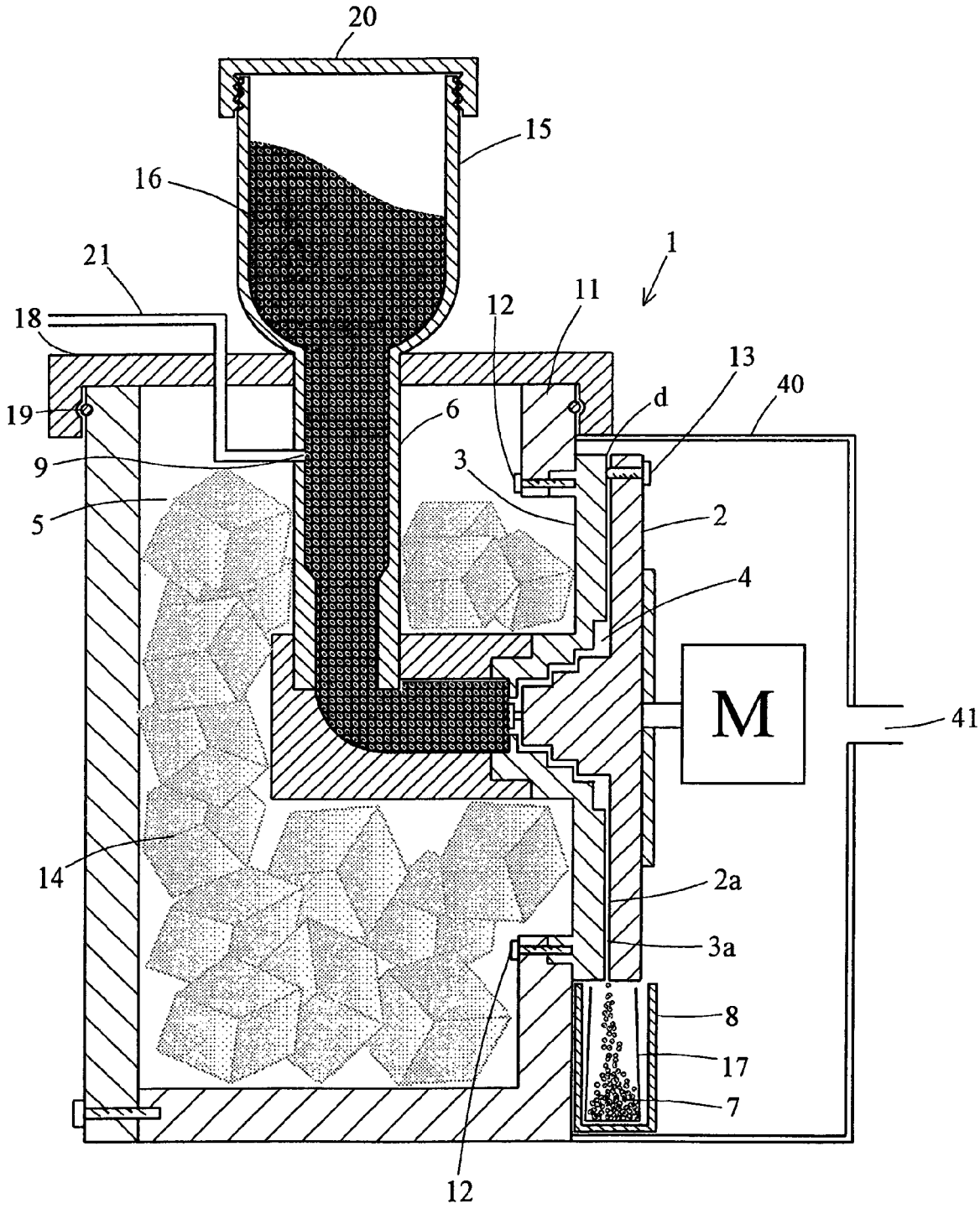
FIG. 3 shows a vertical section of the apparatus for producing the crushed product of Example 3.

In FIG. 3, the apparatus for producing a crushed product used in Example 3 is shown in a vertical front view.

The apparatus for producing the crushed product according to the present invention shown in FIG. 3 is constructed in nearly the same manner as shown in FIG. 1, though ice is used here as the cooling medium 14. The inert gas supply means 9 is arranged here as an opening formed through the side wall of the raw material supply site 6 facing the gas phase space of the cooling section 5 and is connected with an inert gas supply line 21 extending through the cooling section 5 to the outside, so that the inert gas is cooled here before being supplied to the crushing space 4 via the raw material supply site 6. Other constructions are the same as in the apparatus shown in FIG. 1.

The crushed product is produced by the apparatus shown in FIG. 3 in nearly the same way as in Example 1. However, due to the use of ice as the cooling medium 14, crushing of the raw material is effected while cooling the stationary disc 3 and the raw material 16 by ice in the cooling section 5 used as the cooling medium 14. On the other hand, an inert gas, such as nitrogen gas, is supplied to the inert gas supply line 21 from outside, which is cooled in the cooling section 5 before being supplied to the crushing space 4 via the raw material supply site 6, whereupon the crushing of the raw material is effected while cooling the raw material 16, crushed product 7 and the crusher disc 2 under replacement of the ambient oxygen gas occluded in the raw material by nitrogen gas and under simultaneous drying of the raw material 16. In this manner, the crushing can be realized under the isolated control of cooling by the cooling medium 14 in the cooling section 5 and supply of the cooled inert gas independently of each other. Other operations, functions and effects are nearly the same as those by the apparatus shown in FIG. 1.

Example 4

Figure 4:
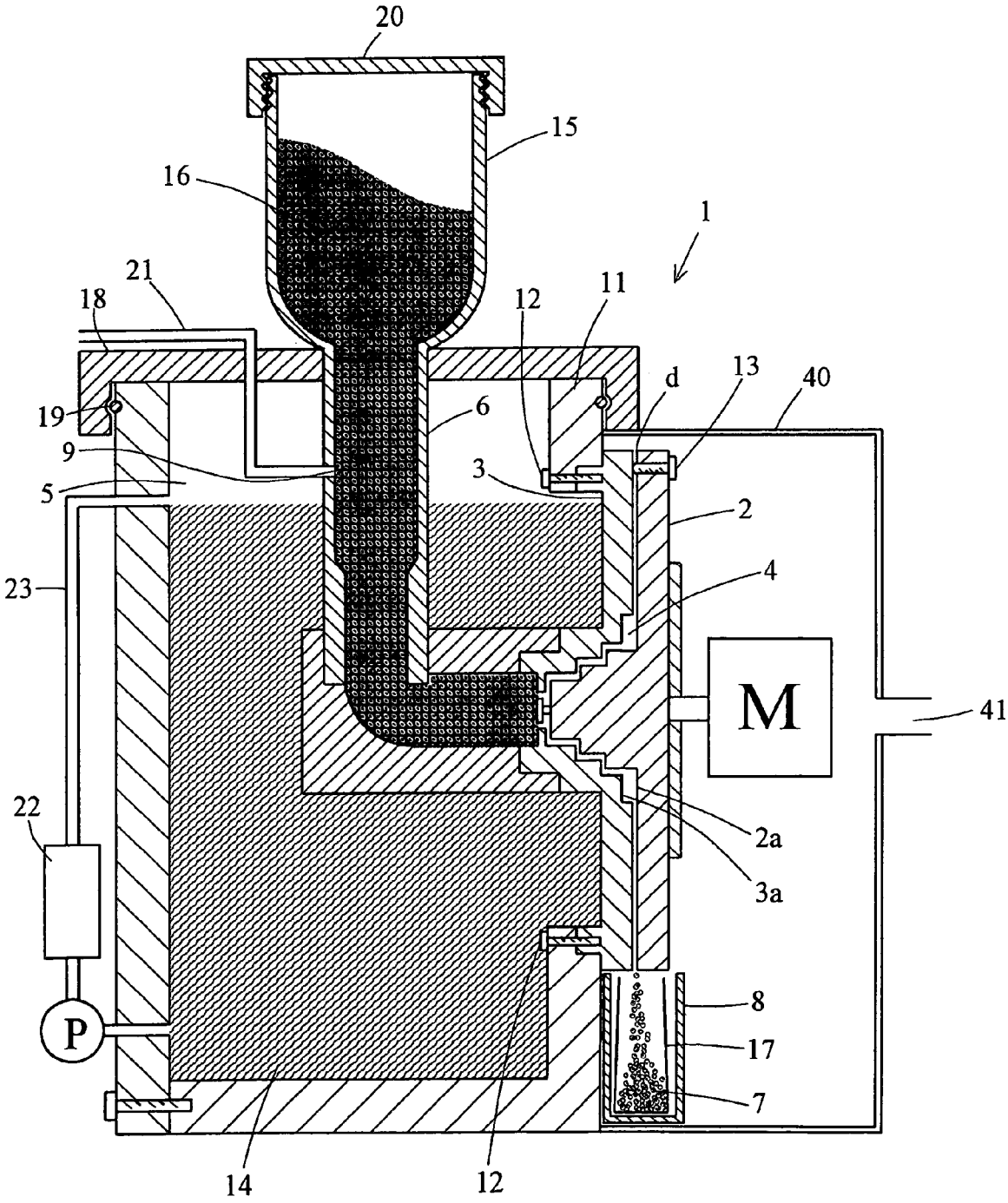
FIG. 4 shows a vertical section of the apparatus for producing the crushed product of Example 4.

In FIG. 4, the apparatus for producing the crushed product used in Example 4 is shown in a vertical front view.

The apparatus for producing the crushed product shown in FIG. 4 is constructed in nearly the same manner as that shown in FIG. 3, wherein, however, a liquid cooling medium, such as water, alcohol or the like, is used in such a manner that a part of the cooling medium is guided out of the cooling section 5 and is circulated by a pump P through a cooler 22 in a circulation line 23 and the here cooled cooling medium 14 is returned to the cooling section 5. The inert gas supply means 9 is arranged as an opening formed through the side wall of the raw material supply site 6 facing the gas phase space of the cooling section 5 and is connected with an inert gas supply line 21 extending through the cooling section 5 to the outside, so that the inert gas is cooled here before being supplied to the crushing space 4 via the raw material supply site 6. Other constructions are the same as in the apparatus shown in FIG. 3.

The crushed product is produced by the apparatus shown in FIG. 4 in nearly the same way as in Example 3. However, due to the use of a liquid medium, such as water, alcohol or the like, as the cooling medium 14, crushing of the raw material is effected while cooling the stationary disc 3 and the raw material 16 by the liquid medium in the cooling section 5 used as the cooling medium 14. A part of the liquid medium as the cooling medium 14 is guided out of the cooling section 5 and is circulated by a pump P through a cooler 22 in a circulation line 23 and the cooled liquid medium is returned to the cooling section 5 so as to keep the temperature of the cooling medium 14 at a constant value. On the other hand, an inert gas, such as nitrogen gas, is supplied to the inert gas supply line 21 from outside, which is cooled in the cooling section 5 before being supplied to the crushing space 4 via the raw material supply site 6, whereupon the crushing of the raw material is effected while cooling the raw material 16, crushed product 7 and the crusher disc 2 under replacement of the ambient oxygen gas occluded in the raw material by nitrogen gas and under simultaneous drying of the raw material 16. In this manner, the crushing can be realized under isolated control of cooling by the cooling medium 14 in the cooling section 5 and of supply of the cooled inert gas independently of each other. Other operations, functions and effects are nearly the same as those by the apparatus shown in FIG. 3.

Example 5

Figure 5:
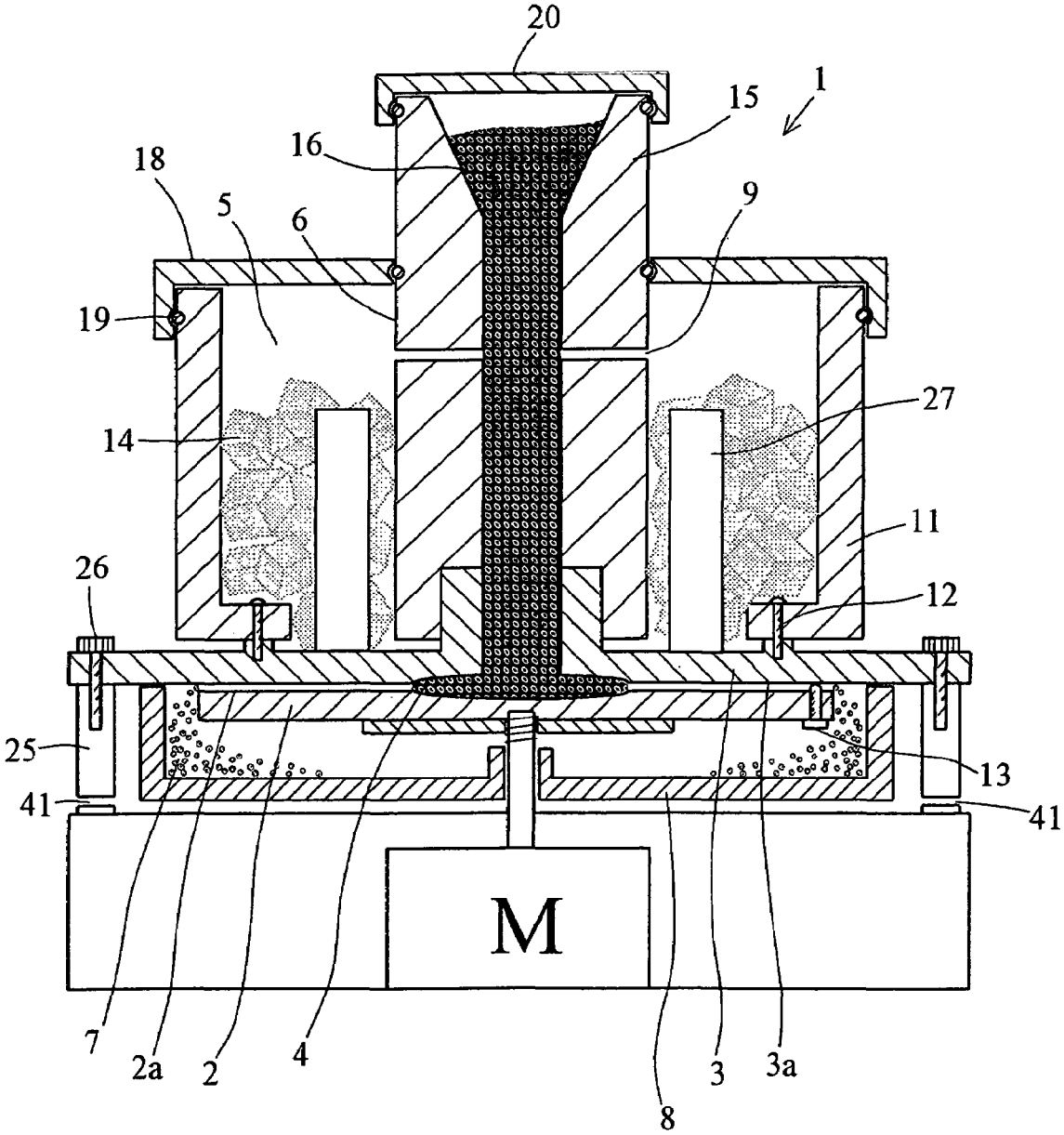
FIG. 5 shows a vertical section of the apparatus for producing the crushed product of Example 5.

In FIG. 5, the apparatus for producing the crushed product used in Example 5 is shown in a vertical front view.

The apparatus for producing a crushed product shown in FIG. 5 is constructed in nearly the same manner as that shown in FIG. 1, wherein, however, a pair of crusher discs 2 and 3 are arranged so as to confront each other in vertical direction to build up a crushing space 4 between the confronting crushing faces 2*a* and 3*a* extending in horizontal direction. One of the paired crushing discs, namely, crushing disc 2 is arranged on the lower side and is connected to a driving means M to constitute a rotary crusher disc. The other crusher disc 3 is arranged on the upper side as a stationary disc by being fixed on the side wall 11 of the cooling section 5 by screw bolts 12 so as to adjoin the cooling section 5. A spacer 13 in a form of a bolt is arranged in a peripheral part of the rotary disc 2 so as to keep a gap d between the crushing faces 2*a* and 3*a* at a constant distance by contacting the top end of the spacer bolt onto the stationary disc 3 while sliding thereon during rotation. The crusher disc 3 is fixed to supporting members 25 each by a screw bolt 26 so as to force the crusher discs 2 and 3 towards each other. The rotary disc 2 has a diameter smaller than that of the stationary disc 3.

The cooling section 5 is arranged above the crusher disc 3 so as to facilitate cooling thereof and is charged therein with dry ice as the cooling medium 14. The raw material supply site 6 communicates with the crushing space 4 through the cooling section 5 via the center of the crusher disc 3, so as to permit the supply of the crushing space 4 with the raw material 16 filled in a storage 15 (hopper) under cooling in the cooling section 5. The crushed product delivery site 8 is arranged beneath the pair of horizontally extending crusher discs 2 and 3 so as to enclose the entire periphery of the rotary crusher 2 in a form adapted to collect the resulting crushed product 7 from the entire periphery of the crusher disc 2.

Since the cooling section 5 is constructed to effect the cooling by means of a cooling medium 14 of dry ice, the thereby generated carbon dioxide gas can be utilized as such for the cooled inert gas. For this, the side wall of the raw material supply site 6 facing the gas phase of the cooling section 5 is provided with openings to be used as the inert gas supply means 9, in order to supply the generated carbon dioxide gas as such for the cooled inert gas to the crushing space 4 via the raw material supply site 6. The cooling section 5 is provided above with a coverage 18 sealed by a sealing member 19. The storage 15 is furnished with a lid 20. The numeral 27 represents a heat radiation member.

The apparatus for producing crushed product shown in FIG. 5 is constructed in nearly the same style as that of FIG. 1. However, due to the arrangement of the crusher discs 2 and 3 in a posture extending in the horizontal direction to effect crushing of the raw material by rotating the rotary crusher disc 2 on a horizontal plane, the crushed product 7 is collected from the crushing space via the entire circumference of the crusher disc 2 to the crushed product delivery site 8 in an oxygen-excluded, denaturation-free, dried and cooled state. The crushed product 7 collected in the crushed product delivery site 8 is brought out in the state accommodated in the product delivery site 8 as such and is brought to practical use in this state as such or after being packaged by being sealed with a sealing cover. Other operations, functions and effects are nearly the same as those using the apparatus of FIG. 1.

While FIG. 5 illustrates an embodiment of using dry ice as the cooling medium 14, the process may be carried out with some alteration of construction of the apparatus for using other cooling mediums 14 such as those shown in FIGS. 2 to 4. The crusher discs 2 and 3 shown in the posture extending in the horizontal direction may be arranged in an inclined posture extending nearly horizontally. Further, variations in minute construction of the crusher discs 2 and 3, the crushing space 4, the cooling section 5, the raw material supply site 6, the crushed product delivery site 8, the inert gas supply means and so on also be permitted.

Figure 6:
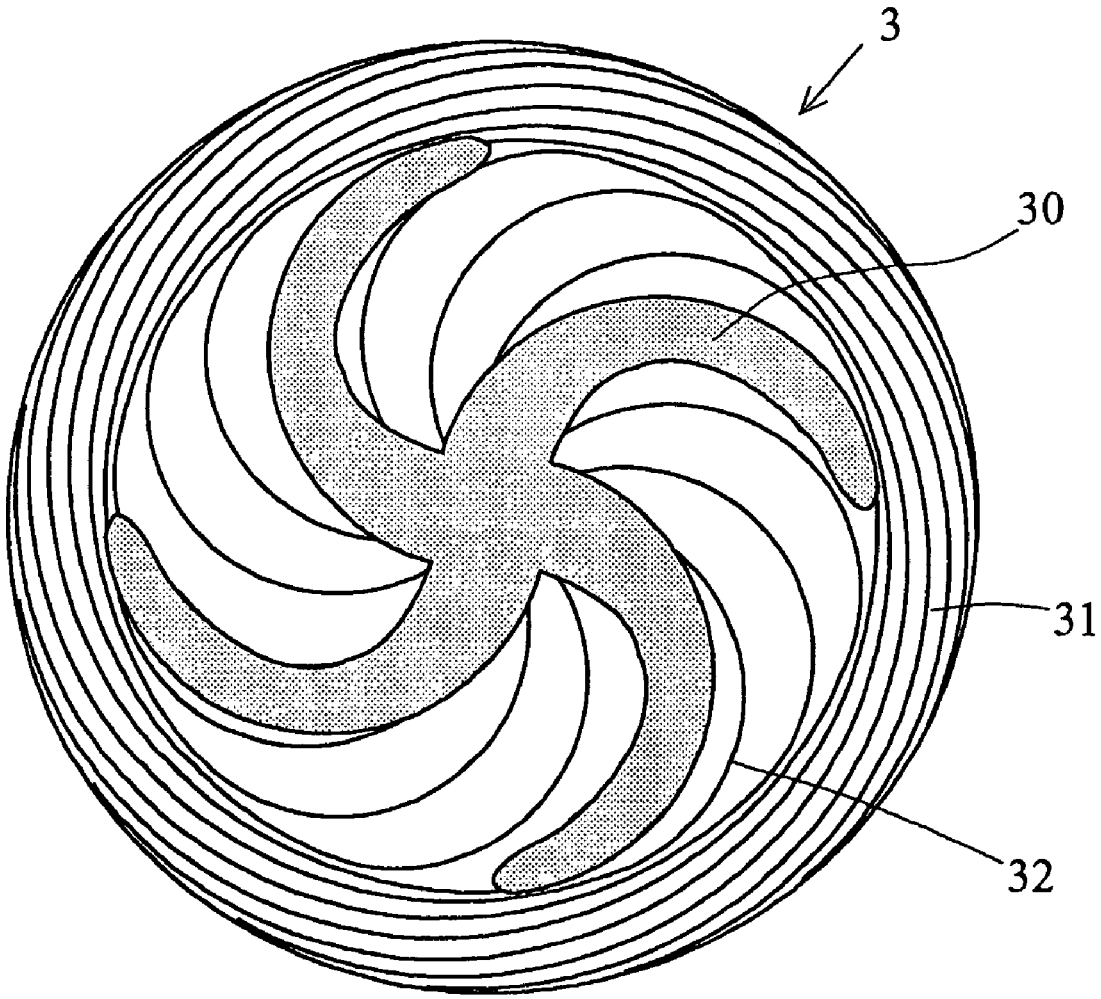
FIG. 6 shows a front view of an example of the crushing faces 2*a* and 3*a* of the crusher discs 2 and 3.

In FIG. 6, an embodiment of the crushing faces 2*a* and 3*a* is shown in a plan view. Here, the crushing space 4 is composed of a rough crushing space constructed from deeper grooves effective for roughly crushing the raw material and of a fine powder crushing space 31 constructed from arcuate shallower thin grooves effective for finely crushing the roughly crushed product into micropowder, namely, comprises deeper grooves 30 constituting the rough crushing space and shallower thin grooves constituting the fine powder crushing space 31. The arcuate shallower thin grooves 32 constituting the fine powder crushing space 31 consist of arcuate grooves formed in a dense arrangement on the crusher disc by laser machining so as to coincide with the flow line of micropowder observed on the crusher disc in accordance with the revolution number of the rotary disc and are in communication with the deeper grooves 30 constituting the rough crushing space by thin grooves 32 formed by laser machining. By overlapping on a machine-cut face formed by ordinary milling machine with a shallow arcuate thin grooves formed by laser machining, the average particle size of the crushed product can be reduced to thereby increase the rate of delivery of the crushed product, whereby the productivity can be increased.

Figure 7:
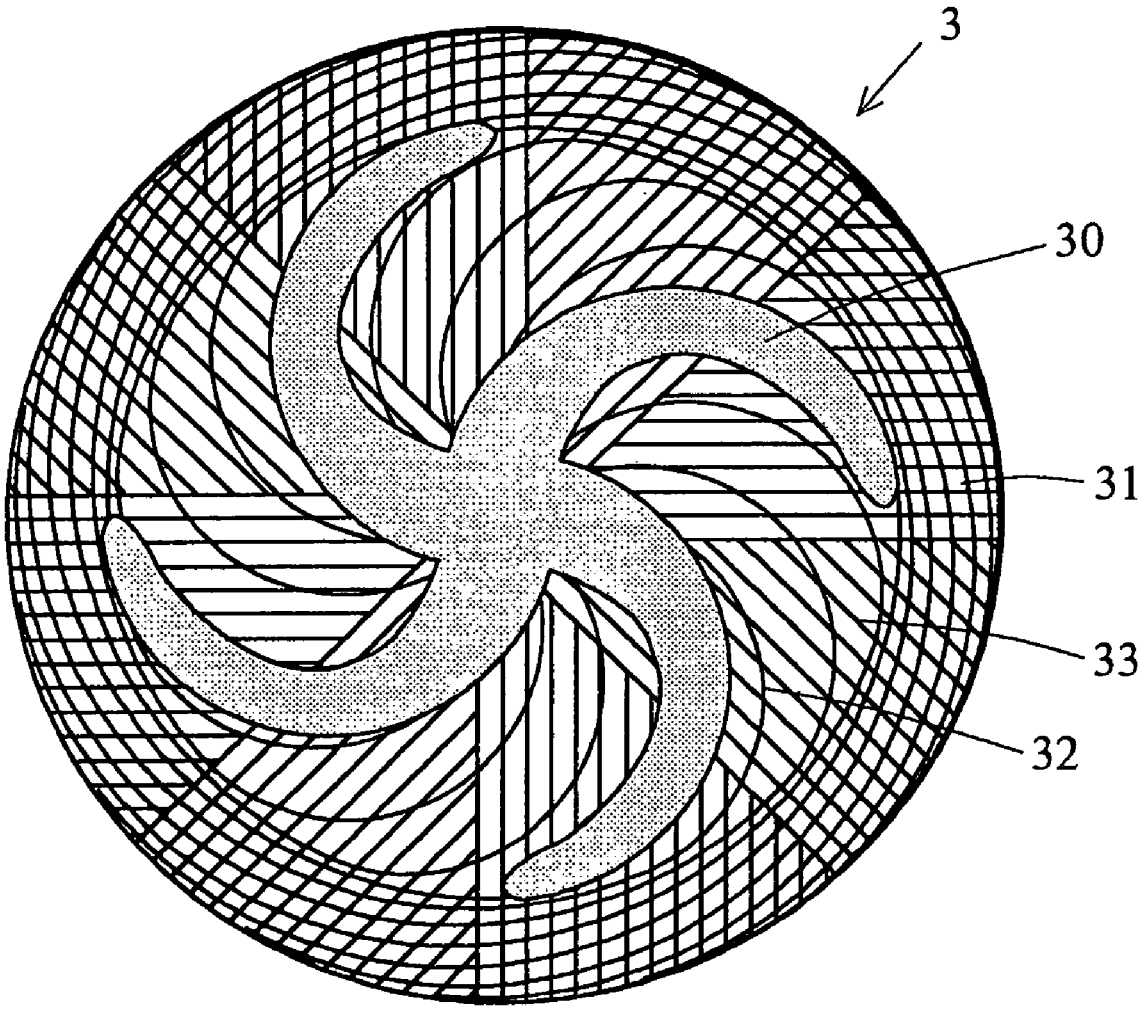
FIG. 7 shows a front view of another example of the crushing faces 2*a* and 3*a* of the crusher discs 2 and 3.

FIG. 7 shows another embodiment of the crushing faces 2*a* and 3*a* of the crusher discs 2 and 3 in a plan view. The crusher discs 2 and 3 were obtained by overlapping on a crusher disc which had been machined to form radial thin grooves 33 thereon by an ordinary milling machine, further deeper grooves 30 constituting the rough crushing space and shallower thin arcuate grooves 32 constituting the fine powder crushing space 31.

A buckwheat powder produced using the technique according to the present invention has an average particle size of 0.036±21.5 mm. Comparing with the average particle size value of 0.103±67.34 mm of commercially available buckwheat powder produced using milling roller and with the average particle size value of commercially available buckwheat powder produced using a stone mill of 0.137±88.14 mm, the powder obtained according to the present invention is superior, since the viscoelastic properties of the powder according to the present invention is superior over the conventional ones and is more adapted to form into hand-made 100%-buckwheat noodle.

The invention claimed is:

1. A method for producing a crushed product, comprising the steps of:

defining a crushing space in between crushing faces of a pair of confronting crusher discs;

forming a rough crushing space for roughly crushing raw materials into a roughly crushed product in the crushing space by providing a first set of grooves in the crushing faces of the crusher discs;

forming a fine powder crushing space for finely crushing the roughly crushed product into micropowder in the crushing space by providing a second set of grooves, which are shallower than the first set of grooves, in communication with the first set of grooves, consist of thin arcuate grooves formed in a dense arrangement on the crusher discs to coincide with a flow line of the micropowder and extend continuously from an inner side to an outer side of the crushing faces of the crusher discs in the crushing faces of the crusher discs;

rotating one of said confronting crusher discs by a driving means;

cooling the crusher discs through a cooling section;

supplying one or more raw materials to the crushing space from a raw material supply site;

supplying a cooled inert gas to the crushing space;

effecting crushing of the raw materials under cooling thereof while replacing ambient oxygen on and around the raw materials by the inert gas; and bringing out the resulting crushed product from the crushing space to a crushed product delivery site.

2. The method as claimed in claim 1, wherein the pair of crusher discs is disposed so as to oppose to each other in a vertical, horizontal or inclined posture.

3. The method as claimed in claim 1, wherein the cooling is effected through the cooling section by means of carbon dioxide gas, ice, water, nitrogen gas or a cooling element.

4. The method as claimed in claim 1, wherein the inert gas is carbon dioxide or nitrogen.

5. A crushing apparatus comprising a pair of crusher discs arranged so as to define a crushing space in between confronting crushing faces thereof, a driving means for rotating one of the crusher discs, a cooling section for cooling the crusher discs, a raw material supply site for supplying one or more raw materials to the crushing space, a crushed product delivery site for bringing out the resulting crushed product thereto from the crushing space and an inert gas supply means for supplying a cooled inert gas to the crushing space wherein the crushing space comprises a rough crushing space for roughly crushing the raw materials into a roughly crushed product and a fine powder crushing space for finely crushing the roughly crushed product into micropowder, the rough crushing space being formed by a first set of grooves provided in the crushing faces of the crusher discs and the fine powder crushing space being formed by a second set of grooves provided in the crushing faces of the crusher discs which are shallower than the first set of grooves, the second set of grooves being in communication with the first set of grooves and consisting of thin arcuate grooves formed in a dense arrangement on the crusher discs to coincide with a flow line of the micropowder and extending continuously from an inner side to an outer side of the crushing faces of the crusher discs.

6. The apparatus as claimed in claim 5, wherein the pair of crusher discs is disposed so as to oppose to each other in a vertical, horizontal or inclined posture.

7. The apparatus as claimed in claim 5, wherein the cooling section performs cooling by means of carbon dioxide gas, ice, water, nitrogen gas or a cooling element.

8. The apparatus as claimed in claim 5, wherein the inert gas is carbon dioxide or nitrogen.

9. A crushing apparatus comprising a pair of crusher discs arranged so as to define a crushing space in between confronting crushing faces thereof, a driving means for rotating one of the crusher discs, a cooling section arranged adjacent to the other one of the crusher discs so as to cool it, a raw material supply site for supplying one or more raw materials to the crushing space through the cooling section, a crushed product delivery site for bringing out the resulting crushed product thereto from the crushing space and an inert gas supply means for supplying a cooled inert gas to the crushing space via the raw material supply site wherein the crushing space comprises a rough crushing space for roughly crushing the raw materials into a roughly crushed product and a fine powder crushing space for finely crushing the roughly crushed product into micropowder, the rough crushing space being formed by a first set of grooves provided in the crushing faces of the crusher discs and the fine powder crushing space being formed by a second set of grooves provided in the crushing faces of the crusher discs which are shallower than the first set of grooves, the second set of grooves being in communication with the first set of grooves and consisting of thin arcuate grooves formed in a dense arrangement on the crusher discs to coincide with a flow line of the micropowder and extending continuously from an inner side to an outer side of the crushing faces of the crusher discs.

10. A method for producing a crushed product, comprising the steps of:

defining a crushing space in between crushing faces of a pair of confronting crusher discs;

forming a rough crushing space for roughly crushing raw materials into a roughly crushed product in the crushing space by providing a first set of grooves in the crushing faces of the crusher discs;

forming a fine powder crushing space for finely crushing the roughly crushed product into micropowder in the crushing space by providing a second set of grooves, which are shallower than the first set of grooves, in communication with the first set of grooves, consists of thin arcuate grooves formed in a dense arrangement on the crusher discs to coincide with a flow line of the micropowder and extend continuously from an inner side to an outer side of the crushing faces of the crusher discs, in the crushing faces of the crusher discs;

rotating one of said confronting crusher discs by a driving means;

cooling the other one of the crusher discs through a cooling section disposed adjacent thereto;

supplying one or more raw materials to the crushing space from a raw material supply site through a cooling section;

supplying one or more raw materials to the crushing space via the raw material supply site;

effecting crushing of the raw materials under cooling thereof while replacing ambient oxygen on and around the raw materials by the insert gas; and bringing out the resulting crushed product from the crushing space to a crushed product delivery site.

11. The method as claimed in claim 10, wherein the pair of crusher discs is disposed so as to oppose to each other in a vertical, horizontal or inclined posture.

12. The method as claimed in claim 10, wherein the cooling is effected through the cooling section by means of carbon dioxide gas, ice, water, nitrogen gas or a cooling element.

13. The method as claimed in claim 10, wherein the inert gas is carbon dioxide or nitrogen.

* * * * *